US007568333B2

(12) United States Patent
St. Germain

(10) Patent No.: US 7,568,333 B2
(45) Date of Patent: Aug. 4, 2009

(54) APPARATUS FOR MAKING SLINGS

(75) Inventor: Dennis St. Germain, Chadds Ford, PA (US)

(73) Assignee: Slingmax, Inc., Aston, PA (US)

( * ) Notice: Subject to any disclaimer, the term of this patent is extended or adjusted under 35 U.S.C. 154(b) by 0 days.

(21) Appl. No.: 11/981,110

(22) Filed: Oct. 31, 2007

(65) Prior Publication Data

US 2009/0107573 A1 Apr. 30, 2009

(51) Int. Cl.
*F16G 9/00* (2006.01)

(52) U.S. Cl. ..... 57/201; 57/21

(58) Field of Classification Search ..... 57/21, 57/201

See application file for complete search history.

(56) References Cited

U.S. PATENT DOCUMENTS 4,724,668 A * 2/1988 Wassenhoven ..... 57/333
4,843,807 A * 7/1989 von Danwitz ..... 57/201

* cited by examiner

*Primary Examiner*—Shaun R Hurley
(74) *Attorney, Agent, or Firm*—Mark A. Garzia, Esq.; Law Office of Mark A. Garzia, P.C.

(57) ABSTRACT

An apparatus for manufacturing industrial slings which is especially adapted for making roundslings. The apparatus can make slings having one load-lifting core or multiple load-lifting cores. The apparatus has three primary sections, namely, a yarn feeder assembly, a control assembly and a tail section assembly. The sling-making apparatus may be left-handed or right-handed.

5 Claims, 3 Drawing Sheets

APPARATUS FOR MAKING SLINGS

FIELD OF THE INVENTION

The present invention relates generally to non-metal slings and, in particular, to an apparatus for manufacturing non-metal roundslings.

BACKGROUND OF THE INVENTION

The term "rigging" (sometimes referred to as industrial rigging or field rigging) is the branch of securing heavy loads in order to prepare the load to be lifted, moved or transported. Rigging usually refers to the ropes, wires, slings, and chains used to secure the load and not the cranes, boomlifts, air skates, forklifts, or other powered equipment that provides the actual force/energy to lift the object.

Wire rope slings made of a plurality of metal strands twisted together and secured by large metal sleeves or collars are common in the industry. Since wire rope slings are made of metal, they do not require any protection that may be afforded by a covering material. During the past thirty years, industrial metal slings have seen improvements in flexibility and strength. However, compared to non-metal or synthetic fiber slings, metal slings are relatively stiff and inflexible.

Synthetic fiber slings have gained popularity over the last approximately twenty years and are replacing metal slings in many circumstances. Thousands of synthetic slings are being used on a daily basis in a broad variety of heavy load lifting applications which range from ordinary construction (e.g., nuclear power plants, skyscrapers and bridges), plant and equipment operations, to ship building (e.g., oil rigs), and the like.

An advantage of synthetic slings over metal slings is that they have a very high load-lifting performance strength-to-weight ratio which provides for a lighter, more flexible and even stronger slings than their heavier and bulkier metal counterparts. An important disadvantage is that synthetic slings require extra steps (primarily encasing the lifting core inside a protective cover), in its manufacturing process.

Synthetic slings are usually comprised of a lifting core made of twisted strands of synthetic fiber and an outer cover that protects the core. The most popular design of synthetic slings is a roundsling in which the lifting core forms a continuous loop and the sling is generally ring-shaped in appearance. The lifting core fibers of such roundslings may be derived from natural materials (e.g., cotton, linen, hemp, etc.), but are preferably made of hemp, linen, etc. synthetic materials, such as polyester, polyethylene, nylon, and the like. The outer covers of synthetic slings are preferably made of synthetic materials and are designed to protect the core fibers from abrasion, cutting by sharp edges, or degradation from exposure to heat, cold, ultraviolet rays, corrosive chemicals or gaseous materials, or other environmental pollutants.

A popular method of manufacturing of prior art roundslings is to twist a plurality of yarns together to form a single strand; the strand was then rolled into an endless parallel loop that formed the core. In a separate step, the cover would be manufactured as a flat piece; then the lifting core would be laid on the flat material, and the flat piece of cover material would be bent around the endless core; finally, the edges of the cover are sewn together thereby encasing the core. This method of manufacturing roundslings is time consuming and labor intensive thus increasing the costs to manufacture the sling.

An important advancement in the rigging industry was the invention of multiple-path slings by Dennis St. Germain. (See U.S. Pat. No. 4,850,629, titled Multiple Path Sling Construction). The manufacturing process for a two-core roundsling is more difficult since it requires more time and labor than a single-core roundsling.

Machines used to manufacture round slings and multiple-path slings are still relatively labor intensive. Accordingly, there is a need in the industry to reduce the amount of labor needed in the manufacturing of synthetic slings.

SUMMARY OF THE INVENTION

It is a primary object of the present document to disclose an apparatus for manufacturing non-metal slings and, in particular, an apparatus for making multiple-path slings.

The subject sling-making apparatus may take on a number of embodiments. However, a preferred embodiment is the making of a two-path industrial sling, i.e., a roundsling having exactly two load-bearing cores.

The apparatus has three primary sections, namely, the yarn feeder assembly, the control assembly and the tail section assembly.

The yarn feeder assembly includes a yarn table consisting of a relatively flat table-top having a first end and a second end. The second end of the yarn table abuts the control assembly.

The control assembly includes an electric motor that provides the motive force for the sling-making apparatus, a power button used to turn the sling-making apparatus on and off, and a control circuit used to track the length of yarn used in the manufacturing of the load-bearing core.

The tail section assembly includes a pair of diametrically opposed rails on which an idler roller assembly rides. The pair of rails abut the side of the control assembly opposite to the side on which the yarn feeder assembly is located. The idler roller assembly is comprised primarily of an idler roller and the mating section for sliding on the rails. The length of the pair of rails depends on the maximum length of sling to which the sling-making apparatus is designed to make. In a preferred embodiment, the length of the rails is forty feet and the idler roller assembly can slide along the rails to make a roundsling up to eighty feet in circumference.

Once the length of the sling to be manufactured is determined, the idler roller assembly is slid, in a straight line, along the rails to the determined position—this is away from the controller assembly for long slings and towards the controller assembly for short slings. The idler roller may be allowed to spin or it may be locked into place.

As will be evident to one skilled in the art, and to provide maximum adaptability for its location, the sling-making apparatus may be left-handed or right-handed. When the yarn table is positioned to the left of the control assembly and the tail section assembly is positioned to the right of the control assembly, the sling-making apparatus is considered left-handed; when the yarn table is positioned to the right of the control assembly and the tail section assembly is positioned to the left of the control assembly, the sling-making apparatus is considered right-handed. However, the side on which each assembly is located with respect to the center control assembly does not affect the operation or process of making a sling.

BRIEF DESCRIPTION OF THE DRAWINGS

The accompanying drawings, which are incorporated in and form a part of the specification, illustrate the embodiments of the present invention and, together with the following description, serve to explain the principles of the invention. For the purpose of illustrating the invention, there are shown in the drawings embodiments which are presently preferred, it being understood, however, that the invention is not limited to the specific instrumentality or the precise arrangement of elements or process steps disclosed.

In the drawings.

DETAILED DESCRIPTION OF THE PREFERRED EMBODIMENT

Figure 1A:
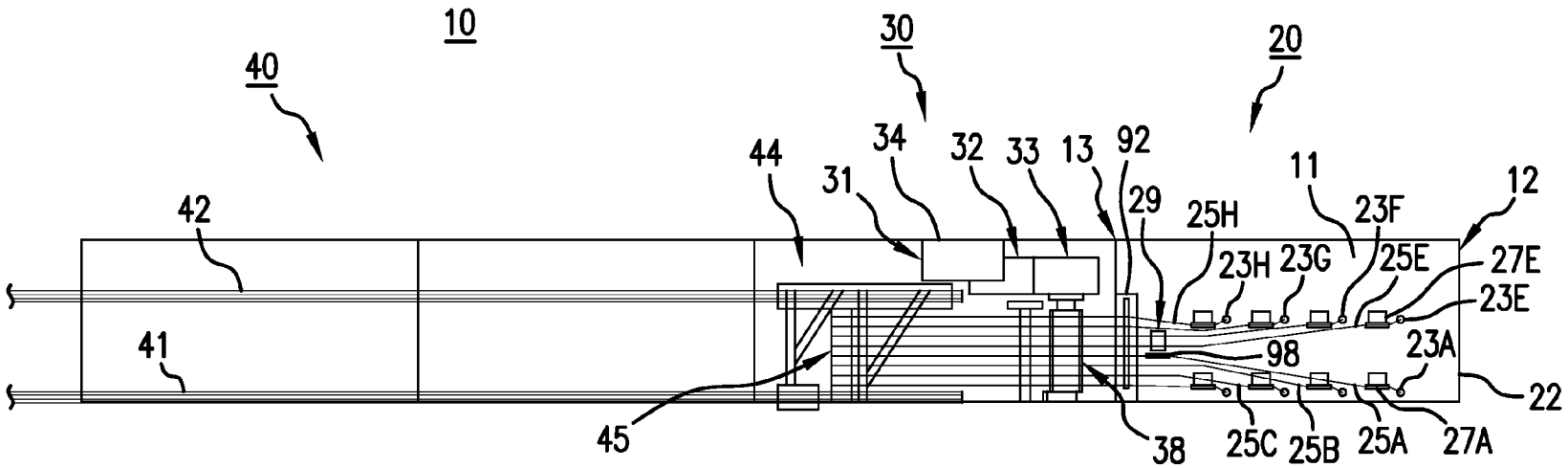
FIG. 1A is a top plan view of an apparatus for making slings in accordance with the present invention.

In describing a preferred embodiment of the invention, specific terminology will be selected for the sake of clarity. However, the invention is not intended to be limited to the specific terms so selected, and it is to be understood that each specific term includes all technical equivalents that operate in a similar manner to accomplish a similar purpose.

Before the invention is disclosed, it is important to remember some terminology used in the rigging industry and to understand the parts of a sling is made. The term "roundsling" is used to refer to a sling having a ring-like or circular shape. A roundsling has two primary sections; namely, a load-bearing core and a tubular cover which protects the load-bearing core. In a single core roundsling, there is one endless load-bearing core. In a roundsling having exactly two load-bearing cores (e.g., TWIN-PATH® brand dual-core slings), the cover has two separate and distinct channels parallel to each other, and two endless load-bearing cores situated within its own respective channel in the cover.

DEFINITIONS

Abrasion: The mechanical wearing of a surface resulting from frictional contact with materials or objects.

Breaking Strength: The total force (lb. or kg.) at which the sling fails. The total weight strain which can be applied before failure, which is usually at least five times the rated capacity.

Core: The load-bearing multiple fibers of synthetic material which when wound into the seamless tubes becomes the load-bearing yarns of the sling.

Cover: The seamless tubes that contains the cores. Covers may be of polyester, covermax, Aramid, or other suitable material depending on the desired finished characteristics of the product. Preferably, the cover is made of an inner material hearing a high visibility color, and an outer material made of a contrasting color; when the outer cover material is damaged or worn through, the inner cover material becomes visible allowing for a quick inspection means.

Elongation: The measurement of stretch, expressed as a percentage of the finished length.

Fitting: A load-bearing metal component which is fitted to the sling. A fitting can be made from steel, aluminum or other material that will sustain the rated capacity of the sling. The fitting must be smooth and large enough to allow the sling to perform without bunching.

Length: The distance between bearing points of the sling when laid flat and closed. Measurements are taken from the inside points of contact.

Proof Test: A term designating a tensile test applied to the item for the sole purpose of detecting injurious defects in the material or manufacture.

Synthetic Fiber: Any of a multiple of man-made materials used to manufacture the cover, the core, and the thread of the non-metal slings.

Tell-Tails: Core yarns which extend past the tag area of each sling. When the sling is stretched beyond its elastic limit, they shrink and eventually disappear under the tag. If either tell-tail is showing less than ½", the sling must be removed from service. If the tell-tails show evidence of chemical degradation, the sling must be removed from service. These may be a fiber-optic cable which will help identify core deterioration.

Thread: The synthetic yarn which is used to sew the slings, covers, tag and also to provide the stitch which separates the individual load covers.

Multiple-path non-metal slings were unknown approximately twenty-five years ago. Dennis St. Germain, the inventor herein, invented multiple-path slings in the mid-1980's. The multiple-path sling and, in particular, a sling having exactly two load-bearing cores, has been a commercial success. Slings having two load-bearing cores are sold under the TWIN-PATH® brand. The multiple-path sling is described in U.S. Pat. No. 4,850,629, titled MULTIPLE PATH SLING CONSTRUCTION. U.S. Pat. No. 4,850,629, is hereby incorporated by reference as if fully set forth herein.

Preferred embodiments of the present invention will now be described in detail with reference to the accompanying drawings in which an apparatus for making slings in accordance with the present invention is generally indicated at 10.

Figure 1B:
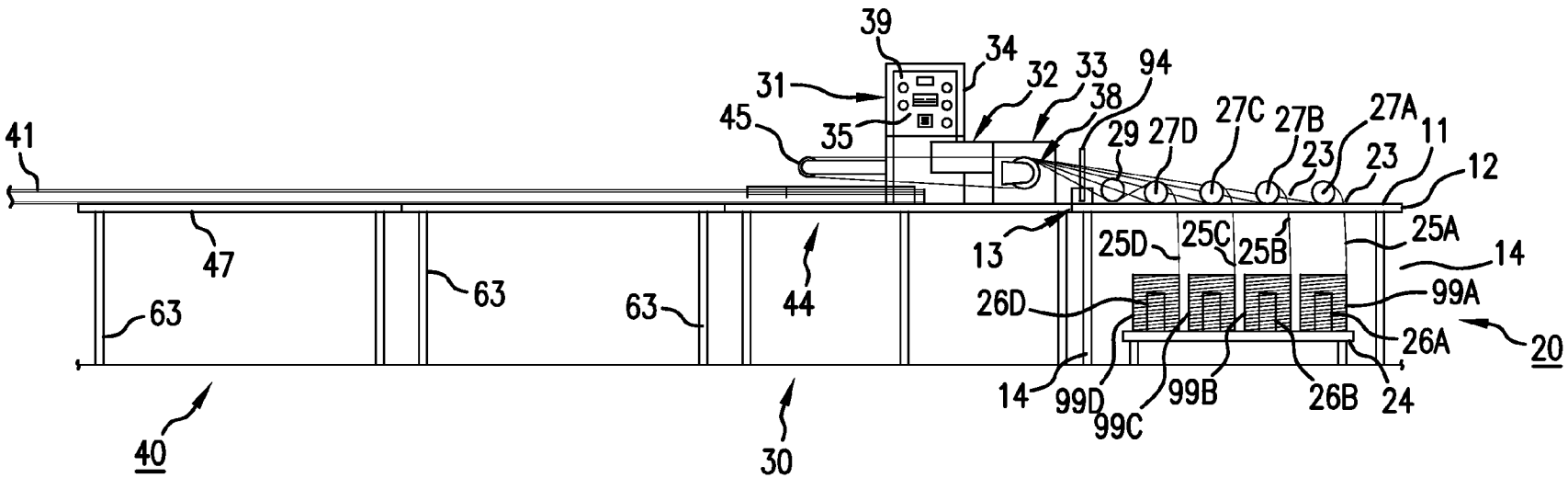
FIG. 1B is a side view of the apparatus illustrated in FIG. 1A.

Referring now to FIGS. 1A and 1B, a yarn feeder assembly 20, a control assembly 30 and a tail section assembly 40 are shown. The yarn feeder assembly 20 includes a yarn feeder table 22 having a flat table top 11 with a first end 12 and a second end 13; the second end is abutted up against and, is preferably attached to, the control assembly 30. As illustrated in FIG. 1B, the yarn feeder table 22 has one or more legs 14 to support the table top 11.

Spaced at regular intervals, the yarn feeder table 22 has a plurality of openings 23 for allowing an individual strand 25 of yarn to pass therethrough. The individual strands of yarn will be twisted together, as will be described herein, to make the load-bearing inner core of the sling. FIG. 1A illustrates an apparatus 10 having exactly eight yarns used to make the inner core; therefore, this particular yarn table has openings 23A through 23H. If the machine is set up to manufacture a multiple-path (e.g., a TWIN-PATH® brand dual-core sling), the yarns are twisted together to make each core of the multiple-path sling.

The individual strands are made in a separate manufacturing step. As an individual strand of yarn is manufactured, it is rolled onto a heavy-weight cardboard tube. Once the desired length of yarn is rolled onto the heavy-weight cardboard tube, the yarns are delivered to customers in a spool or roll 99. The denier, weight and materials used to manufacture the yarn are chosen depending on the type and size of sling to be manufactured. However, in order to reduce inventory, to keep storage space at a minimum, and to streamline the manufacturing process, it is preferable to choose one medium-weight synthetic yarn.

Beneath the yarn feeder table 22 lies a spool table 24 for holding a plurality of spools 99 of yarn. In a preferred embodiment, as illustrated in FIG. 1B, yarn table 22 can hold two rows of four rolls of yarn (for a total of eight rolls), wherein yarn 25A is unrolled from spool 99A, yarn 25B is unrolled from spool 99B, etc. However, not every sling that will be manufactured will use the maximum number of yarns. For example, slings designed and rated to lift relatively small loads may use less than eight yarns.

The spool table 24 has a plurality of elongated extensions 26A, 26B, 26C through 26H (preferably rod-shaped) that extend from the top surface of the spool table towards the underside of the yarn table 22. (Although extensions 26E through 26H cannot be seen from the drawings, each half of the spool table is identical.) A spool of yarn 99 is slid vertically over each of the extensions 26 on the spool table 24 and the spool's weight keeps it on the spool table.

The number of elongated extensions 26 are ultimately determined by the maximum size of sling to be manufactured on the apparatus 10. The number of spools of yarn 99 used to manufacture a specific sling depends on the size of the sling to be manufactured at that time. The number of spools of yarn 99 should not exceed the number of elongated extensions on the spool table. Although the disclosure and the drawings illustrate that there are eight spools of yarn that are slid over eight elongated extensions 26, the spool table can be enlarged to accommodate more elongated extensions 26 and more spools 99 in order to make larger slings. Similarly, apparatus 10 that are designed to make lower-strength slings may not require a yarn table that can accommodate eight yarns.

The number of spools that can be held by the spool table 24 corresponds to the number of openings 23A, through 23H in the yarn table. Once the size of the sling to be manufactured is determined, the number of yarns to be used to form the load-bearing core can be calculated based on the known weight an individual yarn can hold. Although the first time a sling is made, the number of yarns and other factors may be calculated, some of this information may be obtained through trial and error by manufacturing slings made of varying diameters of yarn, destructively testing the sling, and recording the results. Over time, the number of yarns needed to manufacture a specific load-bearing core will become well-known since all of the other measurements are known (e.g., the thickness of the yarn used, etc.) For example, by doing an initial calculation, then through years of experience in making slings, it is known that eight yarns of relatively medium weight synthetic (e.g., Kevlar® of Kevlar® blend) yarn are required to manufacture the load-bearing core of a 20,000 pound sling. This information can be collected and quantified in a chart which can be consulted by the operator immediately before the manufacturing process.

Referring again to FIGS. 1A and 1B, proximate each yarn opening 23A through 23H, is a spring-tensioning device 27A through 27H, respectively. The spring-tensioning devices 27A through 27H applies proper resistance to its respective yarn to prevent any slack in the yarn during the cover-making step. The spring-tensioning devices each have their own adjustment to increase or decrease the amount of tension applied to its respective yarn. The spring-tensioning devices are well-known in the industry.

The sling-making apparatus 10 includes an encoder 29. The location of encoder 29 can be seen in FIGS. 1A, 1B, 3A and 3B. The encoder 29 includes an encoder wheel 98 and its related circuitry that counts the number of revolutions of the encoder wheel.

Figure 4A:
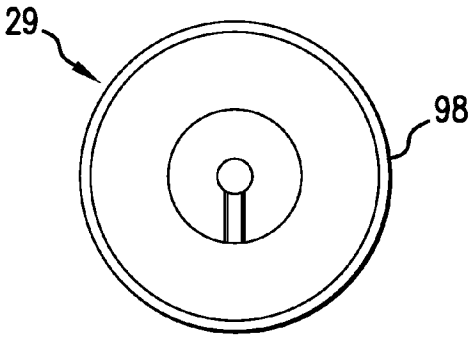
FIG. 4A is a side view of the encoder wheel which forms a part of the control.
Figure 4B:
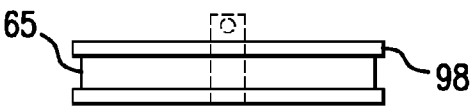
FIG. 4B is a top view of the encoder wheel shown in FIG. 4A.

Referring now to FIGS. 4A and 4B, an enlarged view of the encoder wheel 98 is shown. The encoder wheel 98 has a central groove 65 of known circumference. The circuitry is preferably stored in control box 34. One of the yarns (preferably one farthest away from the control assembly) is wrapped at least partially around the encoder wheel 98. Since the wheel's circumference is known, the length of the yarn used to manufacture the load-bearing core will be easy to compute. As one skilled in the art can appreciate, after reading the present disclosure, the encoder circuitry may be modified to provide a reading in any length measurement (e.g., feet, yards, meters, etc.)

A counter circuit that is connected to the wheel actually determines how many feet are used. Since the circumference of the wheel is known (2*pi*r—where "r" is the radius of the wheel 98 in feet), the number of rotations of the wheel will convey the number of feet of yarn that has been pulled from a roll 99 to make the inner core(s). The encoder and its associated circuitry are well-known off-the-shelf products.

Referring again to FIGS. 1A and 1B, the location of a comb or fiber guide 92 proximate the second end 13 of the yarn table 11 is shown. Preferably the fiber guide 92 is positioned at the junction between the yarn table assembly 20 and the control assembly 30. The fiber guide 92 ensures that the yarns do not prematurely begin twisting and/or become tangled. The fiber guide 92 includes a base section 93 and a plurality of elongated projections 94 (sometimes referred to as "teeth" or "tines"). The base section 93 has a plurality of projection-holding receptacles 95 into which the elongated projections 94 may be inserted. The elongated projections 94 are preferably rod-shaped and are removable and can be re-inserted into different holding recesses to adjust the separation between each individual yarn with respect to adjacent yarns.

Figure 2A:
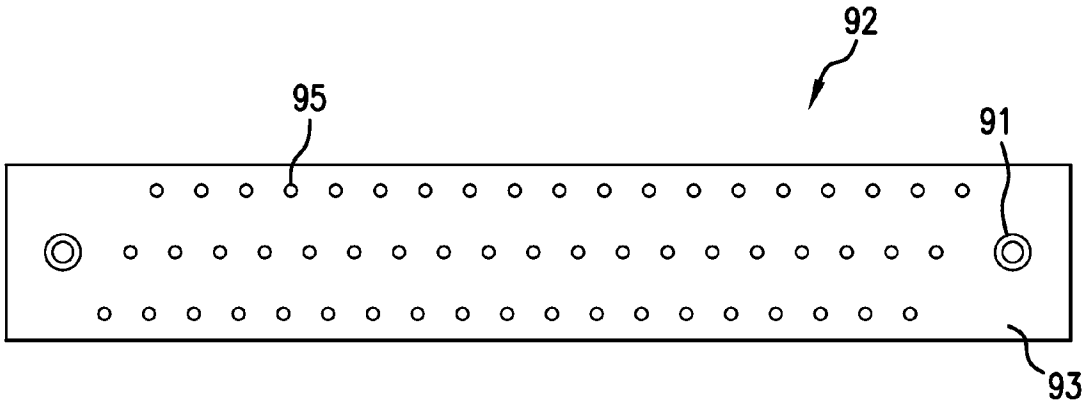
FIG. 2A is a top plan view of the fiber guide/separator that forms a part of the yarn table assembly.
Figure 2B:
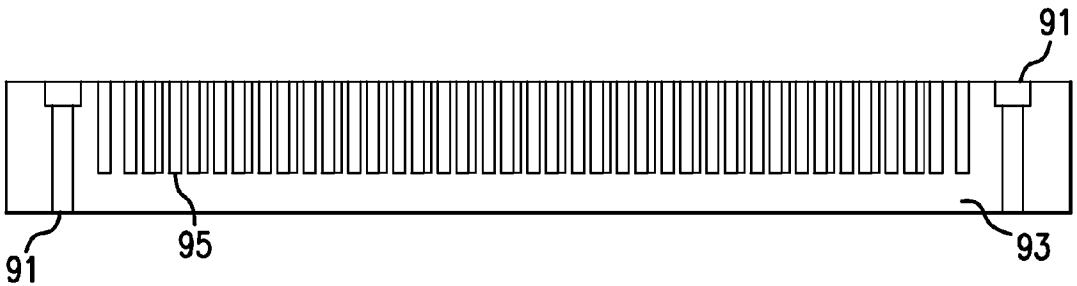
FIG. 2B is a side view of the fiber guide/separator shown in FIG. 2A.

An enlarged view of the base section 93 of the fiber guide 92 is illustrated in FIGS. 2A and 2B. The base 93 may be made of wood or metal and is secured to the yarn table by using bolts 91. The base 93 preferably has more projection-holding receptacles 95 than there are the elongated projections 94. (commonly referred to as "teeth"). Each projection 94 is inserted into a desired receptacle 95 and secured preferably by a friction fit.

The receptacles 95 do not have to be spaced in a regular pattern but it may be easier to manufacture the base 93 if they are spaced apart in a regular or repeating manner. The operator of the machine 10 may insert one or more teeth 94 into the receptacles. The primary factor for determining the number of teeth 94 to be inserted into receptacles 95 is the size of the sling to be made which will determine the number of yarns that will be used to make the core.

The fiber guide 92 is designed to keep the yarns separated until the last possible second to ensure a tight twisting of the yarns as it forms the load-bearing core of the sling. In one embodiment, the teeth 94 are shaped like rods and are frictionally-fitted into the receptacles 95. In another embodiment, one end of each projection 94 can be manufactured with threads, and the receptacles 95 can be manufactured with mating threads so that the projection 94 may be screwed into its respective receptacle. By moving the projection 94 into different receptacles95, the separation of the yarns can be controlled and managed, and ultimately the "tightness" of the wrap of yarns that form the load-bearing core can be controlled.

Referring again to FIGS. 1A and 1B, the control assembly 30, including a control box 34 housing control circuitry, and control panel 31 are illustrated. As stated previously, the counter circuit for the encoder 29 may also be stored in the control box 34. A display 35 that is electrically connected to the counter circuit may be mounted on the control panel 31 for conveying to the machine's operator the length of yarn pulled from the spool 99 of yarn and used to manufacture the load-bearing core.

The control assembly 30 also includes an electric motor 32 that provides the motive force for the apparatus 10. The electric motor 32 turns a drive roller 38 and is connected by a chain (using sprockets), belt or preferably a worm gear reducer 33. An on/off switch 39 controls power to the apparatus 10 and, more specifically to the control circuit.

The encoder 29 along with the encoder wheel 98 are illustrated as being mounted on the yarn table 11, but may be placed anywhere so that at least one yarn can engage the wheel 98 to turn it, thereby allowing the encoder circuit to determine the length of yarn used to manufacture the load-bearing core. The encoder display 35 conveys to the operator how many feet of yarn was used in manufacturing the load-bearing core.

Figure 3A:
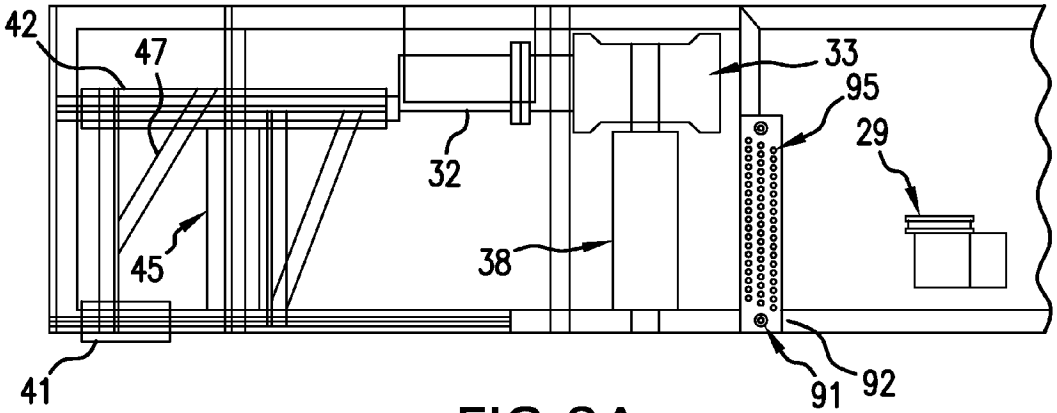
FIG. 3A is a top plan view of the control assembly and tail section assembly of the subject apparatus.
Figure 3B:
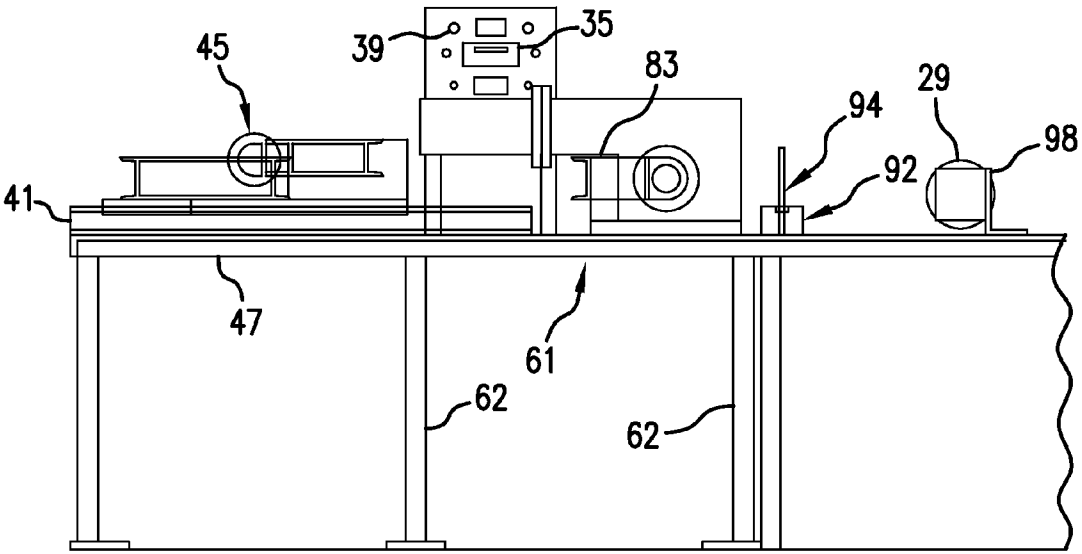
FIG. 3B is a side view of the control assembly and tail section assembly of FIG. 3A.

Referring now to FIGS. 3A and 3B, the control assembly is mounted on a table 61 supported by one or more legs 62. The tail section assembly 40 may be mounted on a table or an open frame 47 so that the working area of the yarn table assembly 20, control assembly 30 and tail section assembly 40 are all relatively in the same working plane. One or more legs 63 support the frame 47 of the tail assembly 40. The apparatus 10 is designed to be somewhat modular to allow for easy assembly and disassembly.

The tail-back assembly 40 is positioned after the control assembly 30. The tail-back assembly 40 includes a pair of rails 41, 42 on which an idler roller section 44 slides. The rails ensure that the idler roller assembly 44, and in particular the idler roller 45, is parallel to the drive roller. This, in turn, ensures that the yarns that form the load-bearing core are properly twisted and slide with the least amount of friction into the cover of the sling.

The idler roller section 44 is slidably attached to the pair of rails 41, 42 for moving the idler roller section in a straight line (i.e., horizontal motion) away from or towards the motor-driven roller 38. The straight-line distance between the idler roller 45 and the driven roller 38 is approximately one-half the size of the sling that is being made. In other words, if it is desired to make a roundsling having a twenty-foot perimeter, the idler roller section is positioned ten feet away from the driven roller.

The idler roller section 44 includes means for locking down the idler roller section to one or both rails 41, 42 thereby preventing the idler roller section 44 from sliding along the rails during the manufacture of the sling. The locking means may be one or more bolts that are secured to the idler roller section 44 and which can be tightened so the bolts frictionally engage one or both rails. As the drive roller 38 pulls the yarn into the cover of the roundsling, a certain amount of tension is created on the idler roller section 44. By locking the idler roller section 44 into place, the load-bearing cores can be manufactured in substantially one continuous step.

In one embodiment, the operator keeps track of the number of feet as indicated on the encoder display 35 and stops the apparatus 10 using the on/off switch when the requisite length of yarn to form the load-bearing core is drawn from the spools 99 of yarn. The actual length of yarn pulled from the spools 99 and used to form the load-bearing cores is not precise as long as the minimum length that was calculated at the beginning of the process is used. A few extra feet will only strengthen the load-bearing cores.

In the preferred embodiment, an electronic decoder control circuit may be employed to automatically turn off the apparatus when the minimum length of yarn is pulled from the spool. As in the manual process, the encoder wheel 29 is used to determine the length of yarn pulled from the spool during the manufacturing of the load-bearing core. The counter circuit can be integrated into the control circuitry via the electronic decoder control circuit for turning off the power to the electric motor when a pre-determined number of feet is pulled from the spool. The operator will program the number of feet of yarn to be used to manufacture the load-bearing cores into the control circuitry at the beginning of the manufacturing process. After the operator turns on the machine 10, the motor will continue to run until the number of feet programmed into the control circuitry is reached as determined by the encoder wheel 29 and signaled to the control circuitry. In this manner, the control circuitry will automatically turn the machine off thereby stopping the motor and the drive roller. Automating this step in the manufacturing process frees the operator to monitor other steps.

As indicated previously, the encoder and its associated circuitry are off-the-shelf items that can be easily incorporated in the power circuit of the present machine 10.

During the manufacturing process, the cover of the sling is placed around the idler roller 45. As indicated previously, a leader yarn has been threaded through the channel of the sling cover. In a sling having two load-bearing cores, the cover has two channels in parallel relationship; in this embodiment, a leader yarn is threaded through both channels in the cover. Similarly, for slings having more than two load-bearing cores, a leader yarn is thread through each channel of the cover.

The cover of the sling is cut to allow access to the interior of the cover. The exposed leader yarn has its ends tied together to form an endless loop. The leader yarn is then placed around the drive roller 38. The idler roller section 44 is then slid away from the control assembly thereby placing tension on the leader yarn. The number of yarns (e.g., eight) that were determined to be needed to form each load-bearing core are then tied to each leader yarn.

When the machine 10 is turned on, the leader yarns, being in frictional contact with the driver roller 38, begins to rotate within their respective cover channels. As the leader yarns rotate, they pull a plurality of yarns off of the spools. As the yarns are pulled from their spools, then through comb 92, and they are drawn eventually through their respective channels in the cover in a circular motion. The plurality of individual yarns begin to twist in a regular manner as they are drawn within the channel of the cover thereby forming the endless-loop load-bearing cores.

A preferred embodiment is the making of a two-path industrial sling. The process of making a two-path sling using the apparatus that is the subject of this patent application is straight forward once the apparatus has been disclosed.

In order to streamline the manufacturing process, the covers are manufactured in an independent step. In this manner, hundreds or thousands of covers can be manufactured at a time. Moreover, the covers can be manufactured off-site using conventional manufacturing techniques. The covers are then shipped to the location where the subject sling-making apparatus is located to manufacture the load-bearing core and for final assembly of the sling. The covers are manufactured with a leader line in each channel. Therefore, if a two-core roundsling is to be made, the cover is manufactured having two channels and there are two leader lines placed in the cover-one for each channel.

The first step in the manufacturing of a sling is to determine the size of sling to be made (including diameter of load-bearing core which depends on the weight to be lifted and the overall length of the sling) and to determine the type of sling to be made. Based on the size (in particular the length), the idler roller assembly 44 is slid along the rails 41, 42 to the proper position and secured by the lock-down means.

The next step in manufacturing a sling involves selecting the appropriate cover material as determined by the sling type and/or customer specifications. Generally, the required length of tubing to form the cover is twice the desired length plus five feet.

In a preferred embodiment, the inner-side of the cover material will be a contrasting color than the outer-side of the cover material to expedite the inspection process.

All multiple-core slings are fabricated using the same basic instructions. The required tube widths and requirements are determined by trial-and-error or through experience, and may be quantified and placed in a chart for future look-up.

Next, the operator moves the (non-rotating) tail stock to the appropriate position as determined by the sling length (2×sling length+about five feet) and secures the tail stock using securing clamps or other means provided to secure the tail stock.

Using a vise grip pliers or other suitable tool, the operator clamps the end of the cover with the long rolled back cuff to the cross bar 83. The operator then pulls the cover towards the tail stock assembly 40 and loops the cover material around the idler roller 45.

The next step in the manufacturing process is to tie the required number of yarns to the leader yarn in the cover. Any excess polyester leader yarn is cut off after tying it to the cover yarns 99. The core yarn is inserted into this original loop, and secured (e.g., by taping) in place allowing a sufficient tail. This tail will be used to tie the beginning yarn to the end yarn after load-bearing core is made.

Once the yarns 99 are tied to the leader yarn, the operator hits the on/off switch 39 to start the electric motor 32 thereby turning the drive roller. The sling-making machine 10 is run until the requisite number of loops, or more accurately the requisite length of yarn 99 has been pulled from the spools. The minimum number of feet of yarn that was calculated at the beginning of the manufacturing process must be pulled from the spools for the size and load-bearing capacity of the sling to be made. (The number of loops of the load-bearing core that are formed depends on the distance between the idler roller and the drive roller.) The motor is pulsed on and off until the original loops and tails are positioned at the drive roller and are accessible to the operator. Since the cover does not rotate during the manufacturing process, the opening of the cover remains proximate to the driver roller.

The operator feeds each of the filler strands through its respective hole in yarn table and through the tension wheels. The operator adjusts the tension wheels to ensure that there is sufficient tension as the drive roller pulls the yarn from its respective spool.

Although any of the yarns may be used to wrap around the encoder wheel 98, the yarn from the spool furthest from the drive roller is preferred.

The operator loops the filler yarns through the bowline knot of each leader string allowing a sufficiently long tail and then tapes them into an interlocking loop.

The operator then places pins in the fiber guide 92 to separate the strands entering the cover paths.

In order to ensure that an appropriate amount of tension is applied to the leader strings, the idler roller 45 may have to be readjusted. The leader strings must be snug against the drive roller 38 so that when the drive roller rotates, the leader string is pulled through its respective channel in the cover. For a multiple-path sling, each leader strings requires substantially equal tension.

The operator ties a (bowline) knot on each leader string at the end of the cuff. While holding the top knotted end of the leader string, the operator loops the bottom end around the drive roller. The operator pulls out any excess slack from each leader string. The operator then pulls the unknotted end until the desired tension is achieved and secures the unknotted end with two half hitches. The operator then cuts off any excess leader string. These steps are repeated for each of the remaining leader strings if all paths are to be run at the same time.

The operator then turns on the machine 10 by switching the switch 39 from off to on, and carefully feeds the yarn into the channels of the covers.

When the counter indicates that the appropriate amount of core material has been used to form the load-bearing cores, the control circuitry from the encoder 29 will automatically stop the machine. As a check, the operator may count the number of strands needed to form each of the load-bearing cores.

The ends of the load-bearing core are tied together. The sling can then be removed from the drive roller 38 and idler roller 44. It should be noted that some slings are best manufactured locking the idler roller 44 to prevent rotation.

The cover is sewn over the opening and closed up allowing only the tell-tails to be seen outside the cover, thereby completing the sling.

Although this invention has been described and illustrated by reference to specific embodiments, it will be apparent to those skilled in the art that various changes, modifications and equivalents may be made which clearly fall within the scope of this invention. The present invention is intended to be protected broadly within the spirit and scope of the appended claims.

I claim:

1. An apparatus for making slings, the apparatus comprising:

a) a yarn feeder assembly;

b) a control assembly; and c) a tail section assembly;

the yarn feeder assembly includes a yarn feeder table having a first end and a second end, wherein the control assembly is located proximate to the second end of the yarn feeder table and the tail section assembly is located proximate the control assembly on the side opposite from the yarn feeder assembly;

spring-tensioning devices positioned on top of said yarn feeder table for applying a force on the yarns as they are drawn by the drive roller;

beneath said yarn feeder table is a spool table for holding a plurality of spools of yarn;

proximate the first end, the yarn feeder table 22 has a plurality of opening 23 for allowing individual strands of yarn to pass therethrough;

the control assembly includes an electric motor, control circuitry for stopping and starting said motor and a drive roller mechanically connected to said electric motor; and the tail section assembly includes an idler roller assembly and means for aligning said tail section assembly to said drive roller; said idler roller assembly housing an idler roller and means for securing the tail section assembly to said aligning means.

2. An apparatus for making slings, the apparatus comprising:

a) a yarn feeder assembly;

b) a control assembly; and c) a tail section assembly;

the yarn feeder assembly includes a yarn feeder table having a first end and a second end, wherein the control assembly is located proximate to the second end of the yarn feeder table and the tail section assembly is located proximate the control assembly on the side opposite from the yarn feeder assembly;

beneath said yarn feeder table is a spool table for holding a plurality of spools of yarn;

proximate the first end, the yarn feeder table 22 has a plurality of openings 23 for allowing individual strands of yarn to pass therethrough;

the control assembly includes an electric motor, control circuitry for stopping and starting said motor and a drive roller mechanically connected to said electric motor; and the tail section assembly includes an idler roller assembly and means for aligning said tail section assembly to said drive roller; said idler roller assembly housing an idler roller and means for securing the tail section assembly to said aligning means, wherein said idler roller includes means for locking the idler roller thereby preventing it from rotating.

3. An apparatus for making slings, the apparatus comprising:

a) a yarn feeder assembly;

b) a control assembly;

c) a tail section assembly; and d) an encoder;

the yarn feeder assembly includes a yarn feeder table having a first end and a second end, wherein the control assembly is located proximate to the second end of the yarn feeder table and the tail section assembly is located proximate the control assembly on the side opposite from the yarn feeder assembly;

beneath said yarn feeder table is a spool table for holding a plurality of spools of yarn;

proximate the first end, the yarn feeder table 22 has a plurality of openings 23 for allowing individual strands of yarn to pass therethrough;

the control assembly includes an electric motor, control circuitry for stopping and starting said motor and a drive roller mechanically connected to said electric motor; and the tail section assembly includes an idler roller assembly and means for aligning said tail section assembly to said drive roller; said idler roller assembly housing an idler roller and means for securing the tail section assembly to said aligning means; and an encoder having a display said encoder communicates with said yarn for determining how much yarn is used in making the load-bearing core.

4. The apparatus of claim 3 wherein said encoder is electrically connected to said control assembly for turning off the electric motor when the required length of yarn to make the specified load-bearing core is drawn from the spools.

5. The apparatus of claim 2 further comprising a fiber guide positioned proximate the second end of the yarn table for keeping the plurality of yarns in alignment before being drawn by the drive roller and twisted into the load-bearing core.

* * * * *